US005104560A

United States Patent [19]

Huster et al.

[11] Patent Number: 5,104,560

[45] Date of Patent: Apr. 14, 1992

[54] ANTI-WEAR ADDITIVE FOR REFRIGERATION OIL

[75] Inventors: James F. Huster, Richton Park; Gerald J. Lepinske, Frankfort; Jerry L. Meinzer, Mokena, all of Ill.

[73] Assignee: Calumet Industries, Inc., Chicago, Ill.

[21] Appl. No.: 446,050

[22] Filed: Dec. 5, 1989

[51] Int. Cl.[5] ..... C10M 131/04

[52] U.S. Cl. ..... 252/58; 252/67; 252/68

[58] Field of Search ..... 252/58, 67, 68

[56] References Cited

U.S. PATENT DOCUMENTS

| | | | |
|---|---|---|---|
| 1,963,917 | 1/1933 | MacLauren | 252/58 |
| 2,822,333 | 2/1958 | Keller | 252/49.6 |
| 3,085,868 | 4/1963 | Champagnat | 44/79 |
| 3,129,185 | 4/1964 | Rizzuti et al. | 252/68 |
| 3,175,972 | 3/1965 | Mitacek et al. | 252/58 |
| 3,209,992 | 10/1965 | Christiansen | 230/206 |
| 3,449,459 | 6/1969 | Asfazadourian et al. | 260/671 |
| 3,630,901 | 12/1971 | Messina | 252/58 |
| 3,715,302 | 2/1973 | Mills et al. | 208/18 |
| 3,912,617 | 10/1975 | Mills et al. | 208/14 |
| 4,010,107 | 3/1977 | Rothert | 252/32.7 |
| 4,084,737 | 4/1978 | Gorman | 252/58 |
| 4,200,543 | 4/1980 | Liston et al. | 252/32.7 |
| 4,359,394 | 11/1982 | Gainer | 252/58 |
| 4,800,013 | 1/1989 | Yamane et al. | 208/19 |

OTHER PUBLICATIONS

Standard Test Methods for Measurement of Extreme Pressure Properties of Fluid Lubricants (Flalex Pin and Vee Block Methods), D 3222-86, Oct. 31, 1986.

Sealed Glass Tube Method to Test the Chemical Stability of Material for Use Within Refrigerant Systems, ASHRAE, Jul. 20, 1983.

Methods of Testing The Floc Point of Refrigeration Grade Oils, ASHRAE, Jan. 13, 1984.

1988 Annual Report, Calumet Industries Inc.

Refrigerating Engineering, "A Method of Evaluating Refrigerator Oils", Elsey et al., Jul. 1952, pp. 737-742.

Kirk-Othmer Encyclopedia of Chemical Technology, 3d ed., vol. 14, John Wiley & Sons, pp. 484-496.

Kirk-Othmer Encyclopedia of Chemical Technology, 3d ed., vol. 17, p. 262.

Kirk-Othmer Encyclopedia of Chemical Technology, 3d ed., vol. 10, John Wiley & Sons, p. 866.

Air Conditioning, Heating & Refrigeration News, May 29, 1989 p. 24.

Frigi-Tech Summary Fact Sheet.

*Primary Examiner*—Prince Willis, Jr.

*Assistant Examiner*—Ellen M. McAvoy

*Attorney, Agent, or Firm*—McAndrews, Held & Malloy, Ltd.

[57] ABSTRACT

Refrigeration oil compositions, additives for forming such compositions, and refrigeration charges comprising a refrigeration oil composition combined with a chlorofluorocarbon refrigerant. The improvement is incorporation the refrigeration oil of a halogenated paraffin as an antiwear additive. Surprisingly, this additive does not substantially decrease the sealed tube stability of the composition, nor does it raise the floc point of the composition when used in an amount effective to increase the Falex failure load of the refrigeration oil composition.

59 Claims, No Drawings

ANTI-WEAR ADDITIVE FOR REFRIGERATION OIL

FIELD OF THE INVENTION

The present invention relates to refrigeration oil, which is lubricating oil disposed within a sealed compressor unit. Refrigeration oil is intended to be miscible and compatible with chlorofluorocarbon refrigerants and compatible with copper, steel, and other materials of compressor parts. The invention also relates to antiwear additives for refrigeration oils and to compressor charges comprising refrigeration oil and the refrigerant or working fluid for the compressor.

BACKGROUND ART

Refrigeration oil is a petroleum derivative consisting essentially of either naphthenic or paraffinic base oils which have been highly refined to remove impurities and high boiling fractions (including waxes).

Refrigeration oil must work over an extremely wide temperature range. For example, in a large industrial air conditioner used in an office building, the oil must work at a temperature as low as −50° Fahrenheit (−46° C.) without hardening or flocculating, and must work in temperatures as high as about 300° F. (149° C.) or more without decomposing substantially. This extremely wide temperature range is necessary because the refrigeration oil is alternately heated and cooled during the cycles of compression and expansion of the working fluid. Thus, one requirement for refrigeration oil is that it have a very low floc point, which can be as low as −65° F. (−54° C.) for some applications. Other applications, such as automotive air conditioners, are less critical and require a floc point of only about −15° F. (−26° C.).

Refrigeration oil also must be compatible with chlorofluorocarbon refrigerants, also called "working fluids" herein. In the presence of unstable oil or an instability-promoting additive, these working fluids generate hydrochloric acid. The free hydrochloric acid thus produced is consumed when it attacks ethylenic or aromatic unsaturation or compounds of nitrogen, oxygen, or sulfur in the refrigeration oil to promote sludge formation. Thus, refrigeration oil must be essentially free of either type of unsaturation, nitrogen, oxygen, and sulfur to prevent its decomposition at elevated temperatures in the presence of chlorofluorocarbon refrigerants.

Resistance of a selected chlorofluorocarbon refrigerant to decomposition in the presence of a selected refrigeration oil is measured by the sealed tube stability test. When measured as described below, the sealed tube stability value of the refrigeration oil should be no more than about one percent decomposition of FREON 12 refrigerant under the test conditions. ("FREON" is a trademark of E.I. du Pont de Nemours & Co., Wilmington, Delaware, for refrigerants. "FREON 12" is a trademark for dichlorodifluoromethane.)

The stability requirements of refrigeration oils are paramount. To avoid instability, formulations of refrigeration oils have avoided using the lubricity-improving additives which are commonly used in other types of lubricants. *Kirk-Othmer Encyclopedia of Chemical Technology,* 3d ed., Volume 14, page 486 (Table 3) states that no additives are commonly used in refrigeration oils.

A third requirement of refrigeration oils is that they should provide a consistently high level of lubricity to protect the working parts of the compressor.

A persistent problem in the art has been to find additives which will increase the lubricity of a refrigeration oil without sacrificing its low floc point and great resistance to decomposition.

U.S. Pat. No. 4,800,013, issued Jan. 24, 1989 (and therefore not prior art under 35 U.S.C. §102(b)), teaches a refrigeration oil composition comprising a mixture of a paraffin base oil and a naphthenic base oil. This reference discloses the production, and some of the characteristics required, of refrigeration oils according to the present invention. This patent does not disclose halogenated paraffins.

Elsey et al., "A Method Of Evaluating Refrigerator Oils", *Refrigerating Engineering,* July 1952, pages 737–742, discloses that refrigerants can react with petroleum-based lubricating oils to form acid gas and carbonaceous sludge. The chlorine from the halogenated refrigerant reacts with hydrogen from the hydrocarbon oil to carbonize and therefore degrade the oil. The reference discloses that the more chlorine the refrigerant contains, the more readily it reacts with hydrocarbons. Fluorine substituents on the refrigerant are recognized to increase the stability of the refrigerant.

Several references disclose the use of halogenated paraffin waxes or oils in compositions not used as refrigeration lubricants.

U.S. Pat. No. 3,085,868, issued to Champagnat on Apr. 16, 1963, discloses addition of a chlorinated mineral wax to a base oil to provide an improved petroleum fuel oil.

U.S. Pat. No. 4,010,107, issued to Rothert on Mar. 1, 1977, teaches a lubricating oil composition useful as an automobile transmission fluid. This lubricant comprises a base oil, various other ingredients, and a chlorinated olefin containing from about 15 to 50 carbon atoms and from 20% to about 60% by weight chlorine. The addition of the chlorinated olefin is taught to prevent or retard corrosion of metal parts of the transmission. The patent does not mention floc points at all. It is also not apparent whether the "chlorinated olefins" discussed in this patent have all their olefinic groups chlorinated, which is necessary to avoid reaction of the composition with chlorofluorocarbon refrigerants.

U.S. Pat. No. 4,200,543 was issued to Liston, et al in Apr. 29, 1980. This patent teaches an internal combustion engine crankcase oil comprising various sulfur-containing anti-oxidants, oil-soluble chlorinated hydrocarbons containing at least six carbon atoms, and an oil-soluble zinc salt. At Column 2, lines 35–45, the patent suggests that the oil-soluble chlorinated hydrocarbon alone does not provide any of the anti-oxidant properties necessary in crankcase oil. The use of chlorinated paraffin waxes is suggested at Column 4, lines 18-23.

In short, references which disclose refrigeration oils have not disclosed chlorinated hydrocarbon lubricant additives at all, and references disclosing chlorinated hydrocarbon additives do not contemplate their use in refrigeration oils. The prior art teaches away from the addition of chlorinated hydrocarbons which lack fluorine substitution to a compressor charge.

SUMMARY OF THE INVENTION

The object of the present invention is a refrigeration oil composition which has the necessary floc point, sealed tube stability, and freedom from sludge promoting impurities, and which also has improved lubricity. Other objects will be apparent from the specification and claims which follow.

One aspect of the present invention is a refrigeration oil composition comprising at least 50% by weight of a refined petroleum (or equivalent) oil and enough of a halogenated paraffin to increase the Falex failure load of the composition. The refined oil is selected from naphthenic oils, paraffinic oils, and mixtures of the two. The refined oil requires a sealed tube stability value, at 200° F. (93° C.) for 48 hours, of less than about 1% decomposition of the refrigerant used in the test. The halogenated paraffin has an average carbon chain length of from about 10 to about 30 carbon atoms, and a combined halogen content of from about 20% to 70% by weight. The preferred halogen is chlorine. The overall composition has a floc point of minus 15° F. (minus 26° C.) or lower. The complete composition also has a sealed tube stability value at 200° F. (93° C.) for 48 hours of no more than about 0.3% greater refrigerant decomposition than the sealed tube stability of the refined oil alone.

A second aspect of the invention is an antiwear additive composition for refrigeration oil. This composition can be blended with conventional refrigeration oils to provide a greater degree of lubricity to the product. This composition comprises at least 25% by weight of refined oil as described above and at least 25% by weight of a halogenated paraffin as described above. The inventors believe that halogenated paraffins of this type have not previously been incorporated in refrigeration oil. The purpose of the refrigeration oil in this additive composition is to improve the miscibility of the product in conventional refrigeration oils.

A third aspect of the invention is a refrigerator compressor lubrication oil charge consisting essentially of from about 1% to about 30% by weight, of a chlorofluorocarbon working fluid and from about 70% to about 99% by weight of a lubricant as described above.

DETAILED DESCRIPTION OF THE PREFERRED EMBODIMENT

This invention is described in connection with certain exemplified embodiments. These embodiments are provided by way of illustration only, and do not limit the full scope of the invention as defined in the claims at the end of this specification. Percentages used herein are by weight unless otherwise indicated.

Broadly, the refined oil and halogenated paraffin are as specified in the Summary.

The refined oils useful herein are conventional refrigeration oils. *Kirk-Othmer Encyclopedia of Chemical Technology* (3d ed.), Volume 14, page 484–496, especially page 486, and Volume 17, page 262, are hereby incorporated herein by reference to show the common characteristics of refrigeration oils. U.S. Pat. No. 4,800,013, issued on Jan. 24, 1989 to Yamane et al. and cited previously, is hereby incorporated by reference for its disclosure of naphthenic and paraffinic base oils and the method in which they are refined and treated to provide refrigeration oils. Refrigeration oils typically have a viscosity of between about 15 and about 100 centistokes at 40° C.

One such refrigeration oil contemplated herein is an ISO 32 viscosity grade naphthenic oil (i.e.. having a nominal viscosity of 32 centistokes at 40° C., as defined by the ISO viscosity standard) which is refined by means such as hydrotreating or hydrogenation of the basic oil. This oil is commonly referred to as yellow refrigeration oil because its color ranges from pale to dark yellow. Yellow refrigeration oil typically has a sealed tube stability of less than 1% decomposition of FREON 12 refrigerant at 200° F. (93° C.) for 48 hours.

Another contemplated refrigeration oil is either a more severely refined, similar viscosity naphthenic oil or a similarly refined, similar viscosity paraffin. If a paraffin is used, it should be aggressively dewaxed to eliminate higher paraffins. (Higher paraffins increase the floc point temperature of the composition.) These oils are water-white in color, so they are commonly known as white refrigeration oils. Because of the need to aggressively dewax paraffin source oils, naphthenic source oils are preferred for use herein.

One particular line of hydrotreated naphthenic refined oils useful herein is the HydroCal II line of lubricants. (HydroCal ® and HydroCal II ® are registered trademarks for lubricants sold by Calumet Industries, Inc., Chicago, Illinois). This particular line of refrigeration oils has a sealed tube stability of less than 0.5% decomposition (as measured herein). The floc points of these refined oils vary, but can be as low as a product specification of minus 65° F. (−54° C.). Refrigeration oils meeting the characteristics required in the present invention are also available from other commercial sources.

The halogenated paraffins useful herein are substituted alkanes. They can have a variety of carbon or alkyl chain lengths, but the preferred oils have a carbon chain length of from about 10 to about 30 carbon atoms, the lower limit being provided so the resulting refrigeration oil is not particularly volatile and the upper limit being provided so the halogenated paraffin will not cause flocculation at the lower temperature ranges required of refrigeration oils. The preferred halogenated paraffins have an average alkyl chain length of from 10 to 24 carbon atoms, more preferably from 10 to about 15 carbon atoms.

The combined halogen content of the halogenated paraffin is conveniently sufficient that a small quantity of this additive can be employed in the refrigeration oil. The more halogenated the paraffin is, the less is required to provide the benefits of the invention. The upper limit of halogenation is dictated primarily by the difficulty of more completely halogenating a paraffin. Neither the lower or upper limit is considered critical. The combined halogen content preferably is from about 20% to about 70% by weight, preferably from about 30% to about 60% by weight, more preferably from about 40% to about 50% by weight.

The halogen used in the halogenated paraffin is selected from chlorine, fluorine, or bromine. Chlorine is specifically contemplated herein. Halogenated paraffins which are both chlorinated and fluorinated are also contemplated herein. The inventors predict that these may provide a greater sealed tube stability than a chlorinated paraffin.

The combinations of refined oil and halogenated paraffin contemplated herein generally contain at least about 25% of the refined oil, preferably at least about 50% of the refined oil, more preferably from about 75% to about 99.5% by weight of the refined oil, still more preferably from about 90% to about 99% by weight of the refined oil, most preferably from about 95% to about 99% by weight of the refined oil. Smaller proportions of refined oil are contemplated for compositions which are intended to be added to a quantity of refrigeration oil to provide increased lubricity. Percentages of the refined oil in the upper parts of the ranges just described are contemplated in compositions to be used directly as refrigeration lubricants.

The combinations of refined oil and halogenated paraffin contain enough of the halogenated paraffin to increase their lubricity, and generally contain from about 0.5% by weight to about 50% by weight, preferably from about 1% to about 10% by weight, more preferably from about 1% to about 5% by weight of the halogenated paraffin. Both concentrates of the halogenated paraffin in refrigeration oil and ready-to-use compositions containing less of the halogenated paraffin are contemplated in the above-stated proportions. The composition containing the halogenated paraffins in concentrated form can be diluted by the end user in additional oil for direct use as a refrigeration lubricant.

Expressed functionally, the minimum proportion of the halogenated paraffin contemplated herein is an amount sufficient to increase the Falex failure load of the composition. A conventional refrigeration lubricant typically has a Falex failure load of substantially less than about 1000 pounds (4400 Newtons) as measured herein. The present refrigeration oil compositions contain enough of the halogenated paraffin to increase their Falex failure loads to at least 1000 pounds (4400 Newtons), preferably at least about 2000 pounds (8900 Newtons), and most preferably at least about 3000 pounds (13,000 Newtons).

The refrigeration oil composition generally should have a floc point of about minus 15° F. (−26° C.) or lower. For demanding applications, the floc point may be required to be about minus 40° F. (−40° C.) or lower, about minus 50° F. (−46° C.) or lower, or even about minus 60° F. (−51°C.) or lower for high performance applications.

Another way of describing the present refrigeration oil compositions is by comparing the properties of the complete composition to the properties of the refined oil alone. The refrigeration oil composition of the present invention preferably has a floc point no more than 5° F. (2.9° C.) higher than the floc point of the refined oil it contains. The sealed tube stability at 200° F. (93° C.) for 48 hours of the claimed composition is preferably no more than 0.3% greater decomposition of FREON 12 (dichlorodifluoromethane), most preferably no more than 0.2% greater decomposition of FREON 12 refrigerant, than the sealed tube stability of the refined oil alone.

The complete composition is preferably essentially free of nonhalogenated paraffin wax, sulfur, nitrogen and oxygen. The refrigeration oils described herein are considered to be essentially free of nonhalogenated paraffin wax if they have a floc point no higher than −20° F. (−29° C.). While there are some sulfur-containing antiwear additives which may provide some benefit in refrigeration oils, the preferred compositions are free of sulfur because it can be a source of instability. Compositions herein are considered to be essentially free of sulfur if they contain less than about 1% by weight sulfur, preferably less than about 0.1 weight percent sulfur, expressed in terms of elemental sulfur. A refrigeration oil composition is considered essentially free of nitrogen if it contains less than about 0.1% elemental nitrogen, and is considered essentially free of oxygen if it contains less than about 0.1% of elemental oxygen.

The refrigeration lubricant compositions described herein are used by incorporating them in either semi-hermetic or hermetic compressor units. The compressor units are separately charged with a refrigerant (charged to the cooling coils or a coolant reservoir) and a lubricant (charged to the sump or other lubricant reservoir). After operation of the unit, some of the coolant intermixes with the lubricant, particularly in the lubricant reservoir, to form a composite charge of the compressor working fluid and refrigeration oil.

The charge of compressor working fluid and refrigeration oil contemplated herein consists essentially of from about 1% to about 30% by weight preferably from about 5% to about 10% by weight, for most applications, of a chlorofluorocarbon working fluid and from about 70% to about 99% by weight, preferably from about 90% to about 95% by weight for most applications, of a lubricant as described above. Chlorofluorocarbon working fluids or refrigerants useful herein are any chlorofluorocarbons conventionally used for refrigeration. A list of such refrigerants can be found in Volume 10, page 866 of the *Kirk-Othmer Encyclopedia of Science and Technology*, 3rd Edition. This list is hereby incorporated herein by reference to show the state of the art. The refrigerants used in the sealed tube stability test described below are also specifically contemplated herein as chlorofluorocarbon refrigerants.

Test Methods

The following methods were used in testing the compositions in the examples which follow. Where test results are specified in the claims, they are the results obtained using the presently described methods.

Sealed tube stability was measured according to ASHRAE Standard 97-1983 (published in 1983), with the following modifications. First, each test sample consisted of 0.5 milliliters of the lubricant or oil being tested, mixed with 0.5 milliliters of FREON 12 (dichlorodifluoromethane). Second, a spring steel catalyst cut from 6 mil (150 micron) stock and 0.1 inch (2.5 mm) wide by 1 inch (25 mm) long was the only catalyst used. Third, the sealed tubes were heat-conditioned in a oven at 200° F. (93° C.) for forty-eight hours. Finally, the gases from the heat-conditioned, sealed tubes were collected and analyzed for decomposition of FREON 12 (dichlorodifluoromethane) using a Model MX-S FTIR (Fourier Transform Infrared) spectrometer with 1200S computer hardware, sold by Nicolet Instrument Corp., Madison, Wisconsin. Dichlorodifluoromethane decomposes to form monochlorodifluoromethane, which differs from the former by replacement of one chlorine atom on each molecule with a hydrogen atom. A low percent decomposition value indicates good stability. ASHRAE standard 97-1983 is hereby incorporated herein by reference. The accuracy of the sealed tube stability test, using the described method, is plus or minus about 0.2%.

The floc points of refrigeration oils were measured according to ASHRAE Standard 86-1983 (published in 1983), which provides a number accurate within 5° F. (2.8° C.). That standard is hereby incorporated herein by reference. The lower the floc point, the better for many applications.

The Falex failure load test was run generally according to Test Method A of ASTM Standard D 3233-86 (published in December, 1986). That standard is hereby incorporated herein by reference. The purpose of the test is to measure the lubricity of an oil during extreme pressure metal-to-metal wear. The ASTM standard test was modified as follows. The test pieces used were number 8 pins and ASI-1137 V-blocks, cleaned thoroughly in petroleum ether, avoiding the use of halogenated solvents. Only specimens free of scratches, nicks, etc. were used.

The test pieces, 60 milliliters of the oil to be tested, and either an 800 pound (3558 Newton) or 3000 pound (13,000 Newton) load gauge was used, depending on the failure load range anticipated. The load gauge (whichever one was used) was initially set to provide a 250 pound (1,112 Newton) load. The machine was started and run for 2 minutes. Then the machine was stopped, the load arm was engaged, and the machine was restarted after 2 minutes. The waiting period after the initial run-in allowed temperature equalization and attainment of viscosity equilibrium in the lubricant cup. Better repeatability was assured by this procedure.

Finally, the machine was restarted and run with a progressively increasing load until the test pieces failed, typically due to the pin becoming welded to the V-block and snapping. Failure was assumed to occur when the direct load dropped significantly, indicating that the pin had broken. The load at failure was recorded. The higher the load was at failure, the better. 3000 pounds (13,000 Newtons) is the maximum load which the 3,000-pound load gauge can apply. Failure loads of 3000+ pounds (13,000+ Newtons) indicate that the test pieces never failed when tested up to 3000 pounds (13,000 Newtons) force.

EXAMPLES

Table I below describes the halogenated paraffins, other additives, and refrigeration oil compositions used in the examples. The refrigeration oil compositions for the examples were made up by diluting the stated percentage by volume of each additive in HydroCal® RO-15 refrigeration oil (a hydrotreated, yellow naphthenic oil). The sealed tube stability of HydroCal® RO-15 oil by itself is about 0.4% to 0.5% decomposition. Its Falex failure load is about 700 pounds (3100 Newtons). Its floc point is about −65° F. (−54° C.) or lower. (RO-15 is a trademark of Calumet Industries, Inc., Chicago, Illinois).

The examples within the scope of the present invention contain a halogenated paraffin additive, have a sealed tube stability of no more than about 0.7 to 0.8% decomposition, have a Falex failure load exceeding about 700 pounds, and have a floc point of about −15° F. (−26° C.) or lower. Thus, examples A through G met all the criteria which were measured. Examples H, I, and J had a somewhat greater than desirable percent degradation, but still provided the desirable lubricity of the present invention.

Table I illustrates that short- and long-chain halogenated paraffins (including some waxes) containing various amounts of combined halogen are useful refrigeration oil additives. Additives having various viscosities are useful herein. Chlorinated paraffins having similar chemical structures, chain lengths, and chlorine contents can provide different results, which means that one should measure all the relevant parameters of a refrigeration oil, and particularly its sealed tube stability, before concluding that an additive in the oil is useful according to the present invention.

Table I also shows (Examples K, L, and M) that some fatty acids and some fatty acid esters may have marginal utility. They are not preferred, however, because they provide a sealed tube stability (decomposition value) which exceeds the decomposition of the base oil by more than 0.3%.

The test was also run using 3% tricresyl phosphate (TCP) (Example P) or a much smaller proportion of dibenzyl disulfide (DBDS) (Example 0) as antiwear additives. These are two antiwear additives commonly used in lubricants for other uses. These additives improved the antiwear properties of the compositions, but at the expense of their sealed tube stability. (Their decomposition values were not within 0.3% of the decomposition value of the base oil.)

Finally, the floc point of composition D was measured and found to be minus 70° F. (−57° C.), thus demonstrating that a composition according to the present invention can have a desirably low floc point.

TABLE I

Part 1

| | Example: | | | | |
|---|---|---|---|---|---|
| | A | B | C | D | E |
| Chem. type[1] | nP | nPW | nP | nP | nP |
| Chain Length[2] | 12 | 20–24 | 11 | 10–13 | 15 |
| % Chlorine | 41 | 45 | 50 | 49 | 51 |
| Viscosity[3] | 51 | 10,500 | 350 | 420 | 1500 |
| % Additive[4] | 3 | 3 | 3 | 3 | 3 |
| % Degradation[5] | 0.5 | 0.6 | 0.7 | 0.7 | 0.7 |
| Falex lbf[6] | 3000+ | 3000+ | 3000+ | 3000+ | — |
| Falex, N[7] | 13,300+ | 13,300+ | 13,300+ | 13,300+ | — |

Part 2

| | Example: | | | | |
|---|---|---|---|---|---|
| | F | G | H | I | J |
| Chem. type | nPW | nPW | nP | nPW | nPW |
| Chain Length | 24 | 20 | 11 | 20–24 | 24 |
| % Chlorine | 43 | 38 | 55 | 42 | 50 |
| Viscosity | — | 560 | 810 | 5100 | 44,000 |
| % Additive | 3 | 3 | 3 | 3 | 3 |
| % Degradation | 0.8 | 0.8 | 1.0 | 1.1 | 1.1 |
| Falex lbf | — | — | 3000+ | — | — |
| Falex, N | — | — | 13,300+ | — | — |

| | Example: | | | | | |
|---|---|---|---|---|---|---|
| | K | L | M | N | O | P |
| Chem. type | FA | FAE | FA | nPW | DBDS | TCP |
| Chain Length | 16–18 | 16–18 | 18 | — | — | — |
| % Chlorine | 30 | 33 | 28 | 70 | — | — |
| Viscosity | 2100 | 650 | 2000 | 5000 | — | — |
| % Additive | 3 | 3 | 3 | 3 | 0.1 | 3.0 |
| % Degradation | 1.2 | 1.4 | 1.4 | 2.3 | 7.5 | 7.6 |
| Falex lbf | 3000+ | 3000+ | — | — | — | — |
| Falex, N | 13,300+ | 13,300+ | — | — | — | — |

[1]Additive Type:
nP is normal paraffin oil
nPW is normal paraffin wax
FAE is fatty acid ester
FA is fatty acid
DBDS is dibenzyldisulfide
TCP is tricresyl phosphate
[2]Alkyl chain length of additive (where appropriate); ranges are as stated, single numbers are average values.
[3]SUS viscosity of additive at 100° F. (38° C.).
[4]% by volume additive in refrigeration lubricant composition.
[5]% degradation of $CCl_2F_2$ to $CHClF_2$ of refrigeration oil during sealed tube stability test.
[6]Falex failure load, lbf.
[7]Falex failure load, Newtons.

What is claimed is:

1. An antiwear additive composition for refrigeration oil, said additive comprising:

at least 25% by weight of a refined oil having a sealed tube stability value at 200° F. (93° C.) for 48 hours of less than about 1%; and at least 25% by weight of a halogenated paraffin having a carbon chain length of from about 10 to about 30 carbon atoms and a combined halogen content of from 20% to 70% by weight;

wherein said composition is essentially free of sulfur.

2. The composition of claim 1, wherein said refined oil is selected from the group consisting of yellow refrigeration oil, white refrigeration oil, and combinations thereof.

3. The composition of claim 1, wherein said refined oil is yellow refrigeration oil.

4. The composition of claim 1, wherein said refined oil is white refrigeration oil.

5. The composition of claim 1, wherein said refined oil consists essentially of naphthenic oil.

6. The composition of claim 1, wherein said halogenated paraffin has an average alkyl chain length of from about 10 to about 24 carbon atoms.

7. The composition of claim 1, wherein said halogenated paraffin has an average alkyl chain length of from about 10 to about 15 carbon atoms.

8. The composition of claim 1, wherein said halogenated paraffin has a combined halogen content of from about 30% to about 60% by weight.

9. The composition of claim 1, wherein said halogenated paraffin has a combined halogen content of from about 40% to about 50% by weight.

10. The composition of claim 1, wherein the halogen of said halogenated paraffin consists essentially of chlorine.

11. The composition of claim 1, comprising from about 25% to about 50% by weight of said refined oil and from about 50% by weight to about 75% by weight of said halogenated paraffin.

12. The composition of claim 1, wherein said refined oil is essentially free of nonhalogenated paraffin.

13. A refrigeration lubricant composition consisting essentially of:

at least 50% by weight of a refined oil selected from the group consisting of naphthenic oils, paraffins, and mixtures thereof, said refined oil having a sealed tube stability value, at 200° F. (93° C.) for 48 hours, of less than about 1% decomposition; and a sufficient quantity of a halogenated paraffin, having an average carbon chain length of from about 10 to about 30 carbon atoms and a combined halogen content of from about 20% to about 70% by weight, to increase the Falex failure load of said composition;

wherein said composition has a floc point of about minus 15° F. (−26° C.) or lower and a sealed tube stability value at 200° F. (93° C.) for 48 hours of no more than about 0.3% greater decomposition than the said sealed tube stability of said refined oil.

14. The composition of claim 13, wherein said refined oil is selected from the group consisting of yellow refrigeration oil, white refrigeration oil, and combinations thereof.

15. The composition of claim 13, wherein said refined oil is yellow refrigeration oil.

16. The composition of claim 13, wherein said refined oil is white refrigeration oil.

17. The composition of claim 13, wherein said refined oil consists essentially of naphthenic oil.

18. The composition of claim 13, wherein said halogenated paraffin has an average alkyl chain length of from about 10 to about 24 carbon atoms.

19. The composition of claim 13, wherein said halogenated paraffin has an average alkyl chain length of from about 10 to about 15 carbon atoms.

20. The composition of claim 13, wherein said halogenated paraffin has a combined halogen content of from about 30% to about 60% by weight.

21. The composition of claim 13, wherein said halogenated paraffin has a combined halogen content of from about 40% to about 50% by weight.

22. The composition of claim 13, wherein the halogen of said halogenated paraffin consists essentially of chlorine.

23. The composition of claim 13, comprising from about 75% to about 99.5% by weight of said refined oil and from about 0.5% by weight to about 25% by weight of said halogenated paraffin.

24. The composition of claim 13, comprising from about 90% to about 99% by weight of said refined oil and from about 1% by weight to about 10% by weight of said halogenated paraffin.

25. The composition of claim 13, comprising from about 95% to about 99% by weight of said refined oil and from about 1% by weight to about 5% by weight of said halogenated paraffin.

26. The composition of claim 13, which is essentially free of elements selected from the group consisting of sulfur, nitrogen, and oxygen.

27. The composition of claim 13, having a Falex failure load of at least about 1000 pounds (4400 Newtons).

28. The composition of claim 13, having a Falex failure load of at least about 2000 pounds (8900 Newtons).

29. The composition of claim 13, having a Falex failure load of at least about 3000 pounds (13,000 Newtons).

30. The composition of claim 13, wherein said floc point is about minus 40° F. (−40° C.) or lower.

31. The composition of claim 13, wherein said floc point is about minus 50° F. (−46° C.) or lower.

32. The composition of claim 13, wherein said floc point is about minus 60° F. (−51° C.) or lower.

33. The composition of claim 13, which has a floc point no more than about 5° F. (2.8° C.) higher than the said floc point of said refined oil.

34. The composition of claim 13, wherein the said sealed tube stability of said composition is no more than about 0.2% greater decomposition than the said sealed tube stability of said refined oil.

35. The composition of claim 13, which is essentially free of nonhalogenated paraffin wax.

36. A refrigeration lubricant composition comprising:

at least 50% by weight of a refined oil selected from the group consisting of naphthenic oils, paraffins, and mixtures thereof, said refined oil having a sealed tube stability value, at 200° F. (93° C.) for 48 hours, of less than about 1% decomposition; and a sufficient quantity of a halogenated paraffin, having an average carbon chain length of from about 10 to about 30 carbon atoms and a combined halogen content of from about 20% to about 70% by weight, to increase the Falex failure load of said composition;

wherein said composition has a floc point of about minus 15° F. (−26° C.) or lower and a sealed tube stability value at 200° F. (93° C.) for 48 hours of no more than about 0.3% greater decomposition than the said sealed tube stability of said refined oil; and wherein said composition is essentially free of sulfur.

37. A refrigerant and lubrication oil composition consisting essentially of from about 1% to about 30% by weight of a chlorofluorocarbon refrigerant and from about 70% to about 99% by weight of a lubricant, wherein said lubricant comprises:

at least 50% by weight of a refined oil having a sealed tube stability value at 200° F. (93° C.) for 48 hours of less than about 1% decomposition; and a sufficient quantity of a halogenated paraffin, having an average carbon chain length of from about 10 to about 30 carbon atoms and a combined halogen content of from about 20% to about 70% by weight, to increase the Falex failure load of said lubricant;

wherein said lubricant has a floc point of about minus 15° F. (−26° C.) or lower and a sealed tube stability value at 200° F. (93° C.) for 48 hours of no more than about 0.3% greater than the said sealed tube stability of said refined oil; and wherein said composition is essentially free of sulfur.

38. The composition of claim 37, wherein said refined oil is selected from the group consisting of yellow refrigeration oil, white refrigeration oil, and combinations thereof.

39. The composition of claim 37, wherein said refined oil is yellow refrigeration oil.

40. The composition of claim 37, wherein said refined oil is white refrigeration oil.

41. The composition of claim 37, wherein said refined oil consists essentially of naphthenic oil.

42. The composition of claim 37, wherein said halogenated paraffin has an average alkyl chain length of from about 10 to about 24 carbon atoms.

43. The composition of claim 37, wherein said halogenated paraffin has an average alkyl chain length of from about 10 to about 15 carbon atoms.

44. The composition of claim 37, wherein said halogenated paraffin has a combined halogen content of from about 30% to about 60% by weight.

45. The composition of claim 37, wherein said halogenated paraffin has a combined halogen content of from about 40% to about 50% by weight.

46. The composition of claim 37, wherein the halogen of said halogenated paraffin consists essentially of chlorine.

47. The composition of claim 37 wherein said lubricant comprises from about 75% to about 99.5% by weight of said refined oil and from about 0.5% by weight to about 25% by weight of said halogenated paraffin.

48. The composition of claim 37, wherein said lubricant comprises from about 90% to about 99% by weight of said refined oil and from about 1% by weight to about 10% by weight of said halogenated paraffin.

49. The composition of claim 37, wherein said lubricant comprises from about 95% to about 99% by weight of said refined oil and from about 1% by weight to about 5% by weight of said halogenated paraffin.

50. The composition of claim 37, which is essentially free of elements selected from the group consisting of nitrogen and oxygen.

51. The composition of claim 37, wherein said lubricant has a Falex failure load of at least about 1000 pounds (4400 Newtons).

52. The composition of claim 37, wherein said lubricant has a Falex failure load of at least about 2000 pounds (8900 Newtons).

53. The composition of claim 37, wherein said lubricant has a Falex failure load of at least about 3000 pounds (13,000 Newtons).

54. The composition of claim 37, wherein said floc point is about minus 40° F. (−40° C.) or lower.

55. The composition of claim 37, wherein said floc point is about minus 50° F. (−46° C.) or lower.

56. The composition of claim 37, wherein said floc point is about minus 60° F. (−51° C.) or lower.

57. The composition of claim 37, wherein said lubricant has a floc point no more than 5° F. (2.8° C.) higher than the floc point of said refined oil.

58. The composition of claim 37, wherein the said sealed tube stability of said lubricant is no more than about 0.2% greater decomposition than the said sealed tube stability of said refined oil.

59. The composition of claim 37, wherein said refined oil is essentially free of nonhalogenated paraffin wax.

* * * * *